US011565312B2

(12) United States Patent
Furusawa

(10) Patent No.: US 11,565,312 B2
(45) Date of Patent: Jan. 31, 2023

(54) SURFACE-TREATED METAL POWDER AND CONDUCTIVE COMPOSITION

(71) Applicant: JX Nippon Mining & Metals Corporation, Tokyo (JP)

(72) Inventor: Hideki Furusawa, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 0 days.

(21) Appl. No.: 17/418,943

(22) PCT Filed: Nov. 8, 2019

(86) PCT No.: PCT/JP2019/043954
§ 371 (c)(1),
(2) Date: Jun. 28, 2021

(87) PCT Pub. No.: WO2020/144931
PCT Pub. Date: Jul. 16, 2020

(65) Prior Publication Data

US 2022/0062988 A1 Mar. 3, 2022

(30) Foreign Application Priority Data

Jan. 11, 2019 (JP) ..... JP2019-003897

(51) Int. Cl.

| | |
|---|---|
| ***H01B 1/22*** | (2006.01) |
| ***B22F 1/145*** | (2022.01) |
| ***H01B 1/02*** | (2006.01) |
| ***H01B 5/14*** | (2006.01) |
| *B22F 1/103* | (2022.01) |

(52) U.S. Cl.
CPC ..... *B22F 1/145* (2022.01); *H01B 1/026* (2013.01); *H01B 1/22* (2013.01); *H01B 5/14* (2013.01); *B22F 1/103* (2022.01); *B22F 1/147* (2022.01); *B22F 2301/10* (2013.01)

(58) Field of Classification Search
CPC ..... B22F 1/00; B22F 2301/10; B22F 1/102; H05K 1/095
See application file for complete search history.

(56) References Cited

U.S. PATENT DOCUMENTS 4,888,135 A * 12/1989 Tsunaga ..... H05K 1/095 428/407

FOREIGN PATENT DOCUMENTS

| | | | | |
|---|---|---|---|---|
| JP | 2001-59101 A | | 3/2001 | |
| JP | 2008-262916 A | | 10/2008 | |
| JP | 2015-36443 A | | 2/2015 | |
| JP | 2015-36444 A | | 2/2015 | |
| JP | 2016-33233 A | | 3/2016 | |
| JP | 2016-33850 A | | 3/2016 | |
| JP | 2016033233 A | * | 3/2016 | ..... B22F 1/02 |
| JP | 5986117 B2 | | 9/2016 | |

OTHER PUBLICATIONS

Search Report and Written Opinion in International Application No. PCT/JP2019/043954 dated Dec. 17, 2019, 9 pages (translation of search report only).
Extended European Search Report in EP Application No. 19908463.3 dated Dec. 1, 2021, 8 pages.
International Preliminary Report on Patentability and Written Opinion in International Application No. PCT/JP2019/043954 dated Jul. 22, 2021, 7 pages.

* cited by examiner

*Primary Examiner* — Khanh T Nguyen
(74) *Attorney, Agent, or Firm* — Marshall, Gerstein & Borun LLP

(57) ABSTRACT

There is provided a more versatile technique that is useful for enhancing the sintering delay property of a metal powder. A metal powder surface-treated with at least one coupling agent comprising Si, Ti, Al or Zr, wherein a total adhesion amount of Si, Ti, Al and Zr is 200 to 10,000 μg with respect to 1 g of the surface-treated metal powder, wherein a 1% by mass aqueous solution of the coupling agent indicates a pH of 7 or less, and wherein a sintering starting temperature is 500° C. or higher.

13 Claims, No Drawings

SURFACE-TREATED METAL POWDER AND CONDUCTIVE COMPOSITION

FIELD OF THE INVENTION

The present disclosure relates to a surface-treated metal powder. The present disclosure also relates to a conductive composition containing a surface-treated metal powder.

BACKGROUND OF THE INVENTION

Conventionally, as a conductive material for producing a composite of a ceramic and a conductor, such as in case of forming an electrode or a circuit on the surface of a ceramic substrate, a conductive composition in which metal particles such as Ag, Cu, Ni or Pt and glass powder having a low softening point are mixed in an organic vehicle is generally known. As a method for manufacturing a composite of a ceramic and a conductor, a method of simultaneously firing a green sheet containing a ceramic with a conductive composition (cofire method) is known. For example, a chip laminated ceramic capacitor is manufactured by printing a conductive composition for an electrode layer on a green sheet (dielectric sheet) with a screen-printing method and then by performing a firing step at a high temperature of about 1000° C.

When a composite of a ceramic and a conductor is produced by the cofire method, it is known that it is useful to enhance the sintering delay property of the conductive composition in order to improve its bonding property to the ceramic substrate. According to Japanese Patent No. 5986117 (Patent Literature 1), it is disclosed that the sintering delay property is dramatically improved without aggregation after surface treatment by mixing copper powder and an aqueous solution of aminosilane to adsorb the aminosilane onto the surface of the copper powder. Claim 1 of this literature discloses "a surface-treated metal power, wherein an amount of adhesion of any one or more of Si, Ti, Al, Zr, Ce, and Sn is 200 to 16000 μg with respect to 1 g of the metal powder, and a weight % of N with respect to the metal powder is 0.02% or more; and wherein the surface-treated metal powder is a metal powder surface-treated with a coupling agent having an amino group at the end".

CITATION LIST

Patent Literature

[Patent Literature 1] Japanese Patent No. 5986117

SUMMARY OF THE INVENTION

According to Patent Literature 1, the sintering delay property is improved only when the metal powder is surface-treated with aminosilane. Therefore, the technique of Patent Literature 1 has a problem that the applicable range of the coupling agent is narrow. Therefore, in one aspect of the present disclosure, an object is to provide a more versatile technique useful for enhancing the sintering delay property of a metal powder.

As a result of diligent studies to solve the above problems, unexpectedly, the present inventor has found that by expediting the self-condensation reaction of the coupling agent more than ever, even if the metal powder is surface-treated with a coupling agent other than aminosilane, the sintering delay property can be improved.

Normally, coupling agents are subjected to a coupling reaction with a metal powder after being stirred overnight in a state of being adjusted to an acidic solution in order to suppress the self-condensation reaction. On the contrary, the inventor dared to stir the coupling agent under a strong alkali of pH 11.5 or more and 13.5 or less to positively promote the self-condensation reaction of the coupling agent before the coupling reaction with the metal powder I and found that the sintering delay property was significantly improved even with a coupling agent other than aminosilane. Although the present invention is not intended to be restricted by any theory, it is considered that by promoting the self-condensation reaction of the coupling agent in advance, a plurality of oxide layers derived from the coupling agent firmly bonded to each other are formed on the surface of the metal fine particles, raising the sintering starting temperature.

The present invention has been completed based on the above findings, and is exemplified as below.

[1]

1. A metal powder surface-treated with at least one coupling agent comprising Si, Ti, Al or Zr, wherein a total adhesion amount of Si, Ti, Al and Zr is 200 to 10,000 μg with respect to 1 g of the surface-treated metal powder, wherein a 1% by mass aqueous solution of the coupling agent indicates a pH of 7 or less, and wherein a sintering starting temperature is 500° C. or higher.

[2]

The surface-treated metal powder according to [1], wherein the sintering starting temperature is 700° C. or higher.

[3]

The surface-treated metal powder according to [1] or [2], wherein the coupling agent has an epoxy group at an end.

[4]

The surface-treated metal powder according to [1] or [2], wherein the metal powder comprises a copper powder.

[5]

The surface-treated metal powder according to any one of [1] to [4], wherein an adhesion amount of Si is 200 μg or more with respect to 1 g of the surface-treated metal powder.

[6]

A metal powder slurry, comprising the surface-treated metal powder according to any one of [1] to [5] and water.

[7]

A conductive composition, comprising the surface-treated metal powder according to any one of [1] to [5], a binder resin, and a dispersion medium.

[8]

The conductive composition according to [7], wherein when a coating film is formed by coating the conductive composition onto a slide glass using an applicator with a 25 μm gap at a moving speed of 5 cm/sec, and drying at 120° C. for 10 minutes, an arithmetic average roughness Ra of the coating film in a coating direction measured with a stylus type roughness meter is 0.2 μm or less.

[9]

A composite of a ceramic and a conductor, manufactured by using the conductive composition according to [7] or [8].

[10]

A laminated ceramic capacitor manufactured by using the conductive composition according to [7] or [8].

[11]

A ceramic circuit board manufactured by using the conductive composition according to claim [7] or [8].

[12]

A sintered body of the surface-treated metal powder according to any one of [1] to [5].

[13]

The sintered body according to [12], wherein the sintered body has a specific resistance of 3.0 μΩ·cm or less.

When a composite of a ceramic and a conductor is manufactured by a cofire method using the metal powder according to one embodiment of the present disclosure, the bonding property between the ceramic and the conductor can be improved.

DETAILED DESCRIPTION OF THE INVENTION

The present disclosure will be described in detail below with reference to embodiments. The present disclosure is not limited to the specific embodiments exemplified as below.

[Metal Powder]

As the metal powder, without limitation, for example, one or two or more types of metal powders selected from the group consisting of Pt powder, Pd powder, Ag powder, Ni powder and Cu powder can be used. In a preferred embodiment, one or two or more metal powders selected from the group consisting of Ag powder, Ni powder and Cu powder can be used. A typical example is Cu powder (copper powder). The Pt powder includes pure Pt powder and Pt alloy powder (particularly Pt alloy powder having a Pt content of 80% by mass or more), the Pd powder includes pure Pd powder and Pd alloy powder (particularly Pd alloy powder having a Pd content of 80% by mass or more), the Ag powder includes pure Ag powder and Ag alloy powder (particularly Ag alloy powder having a Ag content of 80% by mass or more), the Ni powder includes pure Ni powder and Ni alloy powder (particularly Ni alloy powder having a Ni content of 80% by mass or more), and the Cu powder includes pure Cu powder and Cu alloy powder (particularly Cu alloy powder having a Cu content of 80% by mass or more).

The BET specific surface area of the metal powder can be 2 $m^2g^{-1}$ or more and 20 $m^2g^{-1}$ or less, more preferably 3 $m^2g^{-1}$ or more and 20 $m^2g^{-1}$ or less. For example, when the conductive composition is used as an internal electrode of a laminated ceramic capacitor, it is required to make the electrode layer thin in order to realize a small size and a high capacity. In that sense, it is preferable that the BET specific surface area of the metal powder be large. On the other hand, although no particular inconvenience due to the large BET specific surface area can be considered, it is practically difficult to produce a metal powder of 20 $m^2g^{-1}$ or more. The BET specific surface area is measured according to JIS Z 8830: 2013 after degassing the metal powder in a vacuum at 200° C. for 5 hours. The BET specific surface area can be measured using, for example, BELSORP-mini II available from Microtrac BEL.

The D50 of the metal powder is preferably 0.1 to 0.8 μm, more preferably 0.1 to 0.5 μm. If the D50 of the metal powder is too small, it tends to aggregate and the dispersibility of the metal powder in a conductive composition may decrease. On the other hand, if the D50 of the metal powder is too large, the coating film roughness of the conductive composition becomes coarse, and the bonding property between the ceramic and the conductor may decrease. Herein, D50 of the metal powder refers to a volume-based median diameter obtained by a laser diffraction type particle size distribution measurement.

As the metal powder, both a metal powder manufactured by a dry method and a metal powder manufactured by a wet method can be used. It is preferable to use a metal powder manufactured by a wet method since a consistent wet process can be built including the surface treatment with a coupling agent as described later.

A suitable method for manufacturing a copper powder by a wet method will be illustrated by way of example. The manufacturing method comprises a step of adding a dispersant (for example, gum arabic, gelatin, collagen peptide, surfactant, and the like) to a cuprous oxide powder slurry, and after that, a step of adding dilute sulfuric acid to the slurry at once within 5 seconds to carry out a disproportionation reaction. In a preferred embodiment, the slurry can be kept at room temperature (20 to 25° C.) or lower, and dilute sulfuric acid similarly kept at room temperature or lower can be added to carry out the disproportionation reaction. The BET specific surface area (size) of the copper powder can be controlled by the addition amount of the dispersant, the addition rate of dilute sulfuric acid, and the like. As an example, when the amount of organic matter such as gum arabic is large, the BET specific surface area tends to be large, and when the addition rate of dilute sulfuric acid is high, the BET specific surface area tends to be large. In a preferred embodiment, the slurry can be kept at 7° C. or lower, and dilute sulfuric acid similarly kept at 7° C. or lower can be added to carry out the disproportionation reaction. In a preferred embodiment, the dilute sulfuric acid can be added such that the slurry has a pH of 2.5 or less, preferably pH 2.0 or less, and more preferably pH 1.5 or less. In a preferred embodiment, the dilute sulfuric acid can be added within 5 minutes, preferably within 1 minute, more preferably within 30 seconds, even more preferably within 10 seconds, even more preferably within 5 seconds. In a preferred embodiment, the disproportionation reaction can be completed within 10 minutes, for example, within 5 seconds if the addition of dilute sulfuric acid to the slurry is instantaneously carried out. In a preferred embodiment, the concentration of the dispersant such as gum arabic in the slurry before the addition of dilute sulfuric acid can be 0.2 to 1.2 g/L. The mechanism of this disproportionation reaction is as follows:

$$Cu_2O+H_2SO_4 \rightarrow Cu\downarrow+CuSO_4+H_2O$$

If desired, the copper powder obtained by this disproportionation can be washed, rust-proofed, filtered, dried, crushed, and classified, and then mixed with the coupling agent aqueous solution. However, if desired, the metal powder slurry obtained by washing, rust-proofing, and filtering may be mixed with the coupling agent aqueous solution as it is without drying.

It is desirable that the metal powder be surface-treated with a coupling agent. Specifically, it is preferably surface-treated with a coupling agent containing one or more elements selected from the group consisting of Si, Ti, Al and Zr.

As the above-mentioned coupling agent, a coupling agent that is water-soluble and indicates a pH of 7 or less, for example, 2 to 7 when made into a 1% by mass aqueous solution can be used. If the coupling agent is water-soluble, there is an advantage that it can be treated as an aqueous solution and it is not necessary to install a ventilation facility for alcohol. Whether or not the coupling agent is water-soluble is determined by making a 5 wt % aqueous solution and visually confirming that it is not separated from water. In a typical embodiment, the coupling agent does not have an amino group at the end.

Examples of the coupling agent include a silane coupling agent, a titanate coupling agent, an aluminate coupling agent, and a zirconate coupling agent. As the coupling agent, one type may be used, or two or more types may be used in combination. As the coupling agent, Si (when a silane coupling agent is used), Ti (when a titanate coupling agent is used), Al (when an aluminate coupling agent is used), and Zr (when a zirconate coupling agent is used), can be adhered to the surface of the metal powder, respectively.

As a suitable silane coupling agent, a silane coupling agent having at least one hydrolyzable group typified by an alkoxy group such as a methoxy group and an ethoxy group at the terminal in the molecule, and at least one organic functional group such as an epoxy group, a mercapto group, an acryloyl group, a methacryloyl group and a vinyl group, or an acid anhydride group at the terminal in the molecule, can be mentioned.

Examples of the silane coupling agent having an epoxy group include, for example, 3-glycidoxytrimethoxysilane, 3-glycidoxypropyltrimethoxysilane, 3-glycidoxypropylmethyldimethoxysilane, 3-glycidoxypropylmethyldiethoxysilane, 3-glycidoxypropyltriethoxysilane, 2-(3,4-epoxycyclohexyl) ethyltrimethoxysilane, and the like.

Examples of the silane coupling agent having a mercapto group include, for example, 3-mercaptopropylmethyldimethoxysilane, 3-mercaptopropyltrimethoxysilane, and the like.

Examples of the silane coupling agent having an acryloyl group include, for example, 3-acryloxypropyltrimethoxysilane, and the like.

Examples of the silane coupling agent having a methacryloyl group include, for example, 3-methacryloxypropylmethyldimethoxysilane, 3-methacryloxypropyltrimethoxysilane, 3-methacryloxypropylmethyldiethoxysilane, 3-methacryloxypropyltriethoxysilane, and the like.

Examples of the silane coupling agent having a vinyl group include, for example, vinyl trimethoxysilane, vinyl triethoxysilane, and the like.

Examples of the silane coupling agent having an acid anhydride group include, for example, 3-trimethoxysilylpropyl succinic anhydride, and the like.

In order to enhance the sintering delay property, the total adhesion amount of Si, Ti, Al and Zr derived from the coupling agent is preferably 200 μg or more, more preferably 1,000 μg or more, and more even preferably 2,000 μg or more, with respect to 1 g of the surface-treated metal powder. If the total adhesion amount is too small, it is difficult to sufficiently exhibit the sintering delay property. On the other hand, if the total adhesion amount is too large, it becomes difficult to crush the metal powder, so that the metal powder aggregates. As a result, the surface roughness becomes large when a coating film is formed with the paste of the surface-treated metal powder, and the bonding property between the ceramic and the conductor becomes insufficient. In addition, the conductivity and heat dissipation of the sintered body tend to deteriorate. Therefore, the total adhesion amount is preferably 10,000 μg or less, and more preferably 3000 μg or less, with respect to 1 g of the surface-treated metal powder. The total adhesion amount of Si, Ti, Al and Zr can be determined by ICP (inductively coupled plasma atomic emission spectrometry).

In a preferred embodiment, the adhesion amount of Si is 200 to 10,000 μg, more preferably 1,000 to 10,000 μg, with respect to 1 g of the surface-treated metal powder.

When a suitable surface treatment is performed with the above-mentioned coupling agent, the metal powder may exhibit a sintering starting temperature of 500° C. or higher, preferably 700° C. or higher, more preferably 800° C. or higher, and for example, 500 to 1,000° C. Herein, the sintering starting temperature of the metal powder is measured by the following procedure. A cylindrical green compact having a density of 4.7±0.2 $gcm^{-3}$ is formed by hand-pressing 0.5 g of the metal powder using a mold having an inner diameter of φ 5 mm. Then, this green compact is removed from the mold, and loaded into a TMA (Thermomechanical Analyzer) so that the central axis is in the vertical direction, and heated under the following measurement conditions. The temperature at which the shrinkage rate of the sample height reaches 5% is defined as the sintering starting temperature.

<Measurement Conditions>

Gas type: 2 vol % $H_2$—$N_2$

Gas flow rate: 100 mL/min (conversion value at 22° C.)

Temperature rise rate: 5° C./min

Load on top face of green compact: 98 mN

The coupling agent is preferably pretreated to promote the self-condensation reaction before being mixed with the metal powder. In one embodiment, the pretreatment comprises a step of preparing an aqueous solution of a coupling agent by adding an alkaline aqueous solution such as an aqueous solution of ammonia, an aqueous solution of NaOH, an aqueous solution of KOH, or an aqueous solution of monoethanolamine to the coupling agent (preferably adjusting the pH to 11.5 or more and 13.5 or less, and more preferably 12.0 or more and 13.5 or less), and a step of stirring while maintaining the coupling agent aqueous solution at 10° C. to 40° C.

As the pH gets higher, the self-condensation reaction of the coupling agent can be highly promoted. However, if the self-condensation reaction is promoted too much, the coupling agent gels and the dispersibility of the metal powder is lowered. As a result, the coating film becomes rough. Further, as the stirring time gets longer, the self-condensation reaction can be promoted to some degree. But the longer the stirring time is, the lower the productivity becomes. Therefore, the stirring time can be preferably 1 to 72 hours, more preferably 6 to 24 hours.

The aqueous solution of the coupling agent after the pretreatment can be applied to the surface treatment of the metal powder by a known method. For example, after the pretreatment, the aqueous solution of the coupling agent is mixed with the metal powder to obtain a metal powder dispersion liquid. The coupling reaction with the metal powder can be promoted by appropriately stirring by a known method. In a preferred embodiment, stirring can be performed, for example, at room temperature, for example, at temperatures in the range of 5 to 80° C., 10 to 40° C., or 20 to 30° C. Further, stirring is preferably carried out for 1 minute or more, more preferably 30 minutes or more, in order to promote the coupling reaction between the metal powder and the coupling agent.

The concentration of the coupling agent in the aqueous solution of the coupling agent is preferably 10% by volume or more, more preferably 20% by volume or more, in order to promote the self-condensation reaction. Further, in order to prevent the self-condensation reaction from progressing excessively and gelling, the concentration of the coupling agent in the aqueous coupling agent solution is preferably 60% by volume or less, and more preferably 45% by volume or less.

In certain embodiments, stirring can be performed by ultrasonic treatment. The treatment time of the ultrasonic treatment, which is selected according to the state of the metal powder dispersion liquid, is preferably 1 to 180 minutes, more preferably 3 to 150 minutes, even more preferably 10 to 120 minutes, and most preferably 20 to 80 minutes. In a preferred embodiment, the ultrasonic treatment can be carried out at an output of preferably 50 to 600 W, more preferably 100 to 600 W per 100 mL. In a preferred embodiment, the ultrasonic treatment can be carried out at a frequency of preferably 10 to 1 MHz, more preferably 20 to 1 MHz, and even more preferably 50 to 1 MHz.

After the surface treatment with the coupling agent, the surface-treated metal powder can be separated and recovered from the metal powder dispersion liquid. A known method can be used for this separation/recovery, and for example, filtration, centrifugation, decantation, or the like can be used. Following the separation/recovery, drying can be performed if desired. The higher the moisture content of the cake before drying is, the higher the total adhesion amount of Si, Ti, Al and Zr described above tends to be, and vice versa. However, the increase of the total adhesion amount here is due to the unreacted coupling agent adhered to the cake and does not contribute much to the improvement of the sintering delay property. Therefore, even if the total adhesion amount of Si, Ti, Al, and Zr derived from the coupling agent to the metal powder is appropriate, it does not always demonstrate excellent sintering delay property. In order to obtain excellent sintering delay property, it is necessary that the self-condensation reaction of the silane coupling agent is properly carried out.

A known method can be used for drying the cake, and for example, heat drying can be performed. The heat drying can be performed, for example, by heat treatment at a temperature of 50 to 400° C., or 60 to 350° C. for 5 to 180 minutes or 30 to 120 minutes. Following the heat drying, the metal powder may be further crushed, if desired. Further, with respect to the recovered surface-treated metal powder, an organic substance or the like may be further adsorbed on the surface of the surface-treated metal powder for the purpose of preventing rust or improving dispersibility in the paste.

In a preferred embodiment, the surface-treated metal powder may be further surface-treated after being surface-treated with the coupling agent. Examples of such a surface treatment include a rust preventive treatment with an organic rust preventive agent such as benzotriazole and imidazole. Even with such a normal treatment, the surface treatment layer due to the coupling agent will not be desorbed or the like. Therefore, those skilled in the art can perform such known surface treatments as desired within the limits of not losing excellent sintering delay property. That is, the metal powder obtained by further surface-treating the surface of the surface-treated metal powder according to the present disclosure without losing the excellent sintering delay property is also within the scope of the present disclosure.

In a preferred embodiment, a sintered body can be formed by molding a green compact out of the surface-treated metal powder and then heating the green compact in a reducing atmosphere. The resulting sintered body can be used, for example, for an electrode or a circuit. In one embodiment, the specific resistance of the sintered body is 3.0 μΩ·cm or less, preferably 2.5 μΩ·cm or less, more preferably 2.0 μΩ·cm or less, and for example, it can be 1.0 to 3.0 μΩ·cm.

[Conductive Composition]

In one embodiment, the conductive composition according to the present disclosure comprises a metal powder, a binder resin, and a dispersion medium. The conductive composition can be prepared by kneading these components. Kneading can be performed using a known method. In one embodiment, the conductive composition is provided as a paste.

In one embodiment, the conductive composition according to the present disclosure can be used to manufacture a composite of a ceramic and a conductor. As a method for manufacturing a composite of ceramic and conductor, a method of simultaneously firing a green sheet comprising ceramic and a conductive composition (a cofire method) can be preferably adopted. In particular, by using the conductive composition according to the present disclosure, it is possible to obtain a conductor-ceramic composite having a small specific resistance of the conductor and excellent bonding property between the ceramic and the conductor. This property is due, at least in part, to the fact that the metal powder contained in the conductive composition has excellent sintering delay property even in a water vapor atmosphere.

Since the sintered body obtained by firing the conductive composition according to the present disclosure is a conductor, it can be used for, for example, an electrode or a circuit. For example, a laminated ceramic capacitor can be manufactured by applying the conductive composition for an electrode layer on a green sheet (dielectric sheet) by a screen-printing method or the like, followed by a firing step of, for example, 500 to 1,000° C. In this case, the sintered body of the conductive composition is used as an internal electrode of the laminated ceramic capacitor. Similarly, a ceramic circuit board can be manufactured by applying the conductive composition for circuit formation on a green sheet (dielectric sheet) by a screen-printing method or the like, followed by a firing step of, for example, 400 to 1,000° C.

The concentration of the metal powder in the conductive composition is preferably 30% by mass or more, more preferably 35% by mass or more, from the viewpoint of improving the coating film density and further the electrode density. In addition, the concentration of the metal powder in the conductive composition is preferably 90% by mass or less, more preferably 85% by mass or less, from the viewpoint of printability.

In a preferred embodiment, when a coating film is formed by coating the conductive composition onto a slide glass using an applicator with a 25 μm gap at a moving speed of 5 cm/sec, and drying at 120° C. for 10 minutes, an arithmetic average roughness Ra of the coating film in the coating direction measured with a stylus type roughness meter is 0.2 μm or less. The arithmetic average roughness Ra is expressed as an average value when measured at a plurality of locations in accordance with JIS B0633: 2001 with a stylus type roughness meter. A small arithmetic mean roughness Ra means that the metal powder is properly treated with the coupling agent and the metal powder has high dispersibility in the conductive composition. When the dispersibility of the metal powder decreases and agglomerates, the arithmetic mean roughness Ra tends to increase. In this case, due to the formation of voids between the ceramic and the conductor, the bonding property between them is lowered and the conductivity of the conductor is deteriorated. The arithmetic mean roughness Ra is preferably 0.2 μm or less, and more preferably 0.1 μm or less.

[Binder Resin]

Examples of binder resin used in the conductive composition include cellular resin, acrylic resin, alkyd resin, polyvinyl alcohol resin, polyvinyl acetal, ketone resin, urea resin, melamine resin, polyester, polyamide, and polyurethane. As the binder resin, one type of may be used alone, or two or more types may be used in combination. The binder resin in the conductive composition can be contained in a ratio of, for example, 0.1 to 10% with respect to the mass of the metal powder.

[Dispersion Medium]

Examples of dispersion medium used in the conductive composition include alcohol solvent (for example, one or more selected from the group consisting of terpineol, dihydroterpineol, isopropyl alcohol, butylcarbitol, terpineloxyethanol, and dihydroterpineloxyethanol), glycol ether solvent (for example, butylcarbitol), acetate solvent (for example, one or more selected from the group consisting of butyl carbitol acetate, dihydroterpineol acetate, dihydrocarbitol acetate, carbitol acetate, linaryl acetate, and turpinyl acetate), ketone solvent (for example, methyl ethyl ketone), hydrocarbon solvent (for example, one or more selected from the group consisting of toluene and cyclohexane), cellosolves (for example, one or more selected from the group consisting of ethyl cellosolve and butyl cellosolve), diethylphthalate, or propinonate solvent (for example, one or more selected from the group consisting of dihydroterpinylpropionate, dihydrocarbylpropionate, and isobornylpropionate). One type of dispersion medium may be used alone, or two or more types may be used in combination. The conductive composition may contain a dispersion medium so as to have a ratio of, for example, 10 to 400% with respect to the mass of the metal powder.

[Other Additives]

The conductive composition according to the present disclosure can appropriately contain known additives such as a glass frit, a dispersant, a thickener and an antifoaming agent.

A glass frit is useful for improving the bonding property between the ceramic and the conductor. As the glass frit, for example, a glass frit having a diameter in the range of 0.1 to 10 μm, preferably 0.1 to 5.0 μm can be used. The conductive composition may contain a glass frit at a ratio of, for example, 0 to 5% with respect to the mass of the metal powder.

Examples of the dispersant include oleic acid, stearic acid and oleylamine. The conductive composition may contain a dispersant so as to have a ratio of, for example, 0 to 5% with respect to the mass of the metal powder.

Examples of the antifoaming agent include organically modified polysiloxane and polyacrylate. The conductive composition may contain an antifoaming agent so as to have a ratio of, for example, 0 to 5% with respect to the mass of the metal powder.

EXAMPLES

The present disclosure will be described in more detail with reference to examples below. The present disclosure is not limited to the following examples.

Examples 1 to 8, Examples 11 to 16, Reference Examples, Comparative Examples 1 to 11

[Copper Powder]

6 L of pure water was added to a 50 L container and heated so that the liquid temperature became 70° C. 3.49 kg of copper sulfate pentahydrate was added thereto, and while stirring at 350 rpm, it was visually confirmed that all the copper sulfate crystals were dissolved. 1.39 kg of D-glucose was added thereto. A 5 wt % aqueous ammonia solution was added thereto with a liquid feed pump at a rate of 300 mL/min until the pH reached 5. When the pH reached 5, the aqueous ammonia solution was added dropwise with a dropper to raise the pH to 8.4. From here, the liquid was maintained at a temperature of 70±2° C. and pH 8.5±0.1 for 3 hours. The pH was adjusted with an aqueous ammonia solution. After completion of the reaction, decantation, discharge of the supernatant, and washing with pure water were repeated until the pH of the supernatant fell below 8.0 to obtain a cuprous oxide powder slurry. A part of the solid content was taken out and dried in nitrogen at 70° C., and it was confirmed by XRD that this solid content was cuprous oxide.

The water content of the cuprous oxide powder slurry obtained above was adjusted to 20% by mass, and pure water (25° C.) was added to the cuprous oxide powder slurry (25° C.) so that the water content was 7 L with respect to 1 kg of the solid content, and 4 g of glue was further added, and the mixture was stirred at 500 rpm. 2 L of 25 vol % dilute sulfuric acid (25° C.) was instantaneously added thereto to adjust the pH to 0.7. The powder was precipitated by decantation, the supernatant was drained, 7 L of pure water (25° C.) was added, and the mixture was stirred at 500 rpm for 10 minutes. The decantation and washing operations were repeated until the $Cu^{2+}$-derived Cu concentration in the supernatant became less than 1 g/L, and thereby obtaining a copper powder slurry having a water content of 20% by mass.

A part of the obtained solid content was taken out and dried in nitrogen at 70° C., and it was confirmed by XRD that this solid content was copper. Further, after degassing the solid content, which was copper powder, at 200° C. for 5 hours in a vacuum, the BET specific surface area was measured using BELSORP-mini II available from MicrotracBEL. and found to be 3.2 $m^2g^{-1}$. Further, for the solid content, which was copper powder, the volume-based median diameter (D50) was measured by a laser diffraction type particle size distribution measurement (MASTERSIZER 3000 available from Malvern Panalytical Ltd). When the copper powder slurry was added to a 0.2 wt % sodium hexametaphosphate aqueous solution and the slurry was irradiated with ultrasonic waves while being heated at 40° C., the D50 was 0.4 μm.

[Manufacturing of Surface-Treated Copper Powder]

The following coupling agents were prepared as the coupling agents.

- Epoxysilane: 3-glycidoxypropyltrimethoxysilane (available from Shin-Etsu Chemical Co., Ltd., KBM-403)
- Vinylsilane: Vinyltrimethoxysilane (available from Shin-Etsu Chemical Co., Ltd., KBM-1003)
- Methacrylsilane: 3-methacryloxypropyltriethoxysilane (available from Shin-Etsu Chemical Co., Ltd., KBM-503)
- Acrylic silane: 3-acryloxypropyltrimethoxysilane (available from Shin-Etsu Chemical Co., Ltd., KBM-5103)
- Mercaptosilane: 3-mercaptopropyltrimethoxysilane (available from Shin-Etsu Chemical Co., Ltd., KBM-803)
- Titanate coupling agent: Titanium diisopropoxybis (triethanolaminate) (available from Matsumoto Fine Chemical Co., Ltd., Orgatix TC-400)
- Zirconate coupling agent: Zirconyl chloride compound (available from Matsumoto Fine Chemical Co., Ltd., Orgatix ZC-126)

The pH of each of the above coupling agents was measured when it was made into a 1% by mass aqueous solution, and the results are shown in Table 1.

According to the test number, each of the above coupling agents was mixed with pure water, and further adjusted to the predetermined pH shown in Table 1 with aqueous ammonia to obtain each of various coupling agent aqueous solutions. This was stirred at 25° C. for 14 hours to promote the self-condensation reaction of the coupling agent. However, in Comparative Examples 6 to 11, the pH was not adjusted by adding aqueous ammonia, and only stirring was performed, so the pH measurement results were shown as they were. Next, 550 g of the above copper powder slurry having a water content of 20% by mass was mixed with the aqueous solution that had undergone this pretreatment, and the mixture was stirred at 25° C. and 500 rpm for 1 hour. Table 1 shows the concentration of the coupling agent in the aqueous solution of the coupling agent. After stirring, solid-liquid separation was performed by suction filtration, and the copper powder was recovered as a cake having a predetermined water content ("Cake water content before drying" in the table). The water content was confirmed by drying at 100° C. using an infrared aquameter FD-660. The obtained cake was dried at 100° C. for 2 hours in a nitrogen atmosphere. The obtained dried powder was crushed in a mortar and pestle until it passed through a sieve with 0.7 mm meshes, and further crushed by a jet mill. In this way, various surface-treated copper powders were obtained.

Example 9

As a nickel powder, NF32 (D50=0.3 μm, BET specific surface area=3.3 $m^2 g^{-1}$) available from Toho Titanium Co., Ltd. was prepared, and pure water was added to prepare a nickel powder slurry having a water content of 20% by mass. After that, a surface-treated nickel powder was obtained by the same procedure as in Example 1.

Example 10

126 g of silver nitrate was dissolved in 8 L of pure water, 0.24 L of 25% aqueous ammonia was added, and 0.4 kg of ammonium nitrate was further added to prepare a silver ammine complex salt aqueous solution. Gelatin was added to this at a ratio of 1 g/L, and this was used as an electrolytic solution. Using DSE electrode plates for both the anode and cathode, electrolysis was performed at a current density of 200 $Am^{-2}$ and a solution temperature of 20° C. for 1 hour while scraping the electrodeposited silver particles from the electrode plate. The silver powder thus obtained was filtered through Nutsche and washed with pure water to obtain a silver powder slurry having a water content of 20% by mass. A part of the obtained solid content was taken out and dried in nitrogen at 70° C., and it was confirmed by XRD that this solid content was silver. Further, when the volume-based median diameter (D50) of the solid content, which was a silver powder, was measured by the same procedure as in Example 1, it was 0.2 μm. Further, when the BET specific surface area of the solid content, which was a silver powder, was determined by the same procedure as in Example 1, it was 3.7 $m^2g^{-1}$.

The silver powder slurry having a water content of 20% by mass obtained above was surface-treated in the same procedure as in Example 1 to obtain a surface-treated silver powder.

[Analysis of Metal Concentration Derived from Coupling Agent]

Each surface-treated metal powder of Examples and Comparative Examples obtained in the above procedures was dissolved with an acid, and the mass (μg) of adhered Si, Ti, and Zr with respect to the unit mass (g) of the surface-treated metal powder was determined by ICP emission spectroscopic analysis (ICP-OES available from Hitachi High-Tech Science Co., Ltd.). The results are shown in Table 1. In addition, the table does not show the element concentration below the lower limit of detection.

[Measurement of Sintering Starting Temperature by TMA]

0.5 g of each metal powder obtained above was hand-pressed using a mold having an inner diameter of φ 5 mm to form a cylindrical green compact having a density of 4.7±0.2 g $cm^{-3}$. The green compact was removed from the mold and loaded into TMA (Thermomechanical Analyzer) so that the central axis was in the vertical direction. The temperature at which the shrinkage rate of the sample height reaches 5% when heated under the following measurement conditions was defined as the sintering starting temperature.

<Measurement Conditions>

TMA (Thermomechanical Analyzer): TMA4000 (NETZSCH Japan K.K.)

Gas type: 2 vol % $H_2$—$N_2$

Gas flow rate: 100 mL/min (conversion value at 22° C.)

Temperature rise rate: 5° C./min

Load on top face of green compact: 98 mN

[Preparing Metal Powder Paste]

A vehicle was prepared by thoroughly kneading terpineol and ethyl cellulose through a planetary centrifugal mixer AR-100 and three rolls in advance. Next, the vehicle, oleic acid, and each of the surface-treated metal powders of the above Examples and Comparative Examples were mixed such that the ratio of metal powder:ethyl cellulose:oleic acid:terpineol=80:2.3:1.6:16.1 (mass ratio). After pre-kneading with a planetary centrifugal mixer, it was passed through three rolls (finishing roll gap of 5 μm) and defoamed using a planetary centrifugal mixer to prepare each metal powder pastes of Examples and Comparative Examples.

[Surface Roughness of Coating Film (Ra)]

Each of the metal powder pastes of Examples and Comparative Examples obtained in the above procedure was applied onto a slide glass using an applicator with a 25 μm gap at a moving speed of 5 cm/sec, and dried at 120° C. for 10 minutes. Ra (JIS B0633: 2001 compliant) in the coating direction of the obtained coating film was measured at 5 points with a stylus type roughness meter, and the average value was taken as the measured value. The results are shown in Table 1.

[Specific Resistance of Sintered Body]

Using each of the metal powder pastes of Examples and Comparative Examples obtained in the above procedure and a screen printing plate (stainless steel mesh, wire diameter 18 μm, screen thickness 38 μm, opening 33 μm, opening ratio 42%), three lines having a width of 5 mm and a length of 20 mm were printed on a green sheet (GCS71 available from YAMAMURA PHOTONICS CO., LTD.). While supplying the nitrogen atmosphere having a total pressure of 1 atm including a water vapor partial pressure of 0.03 atm at 2 L/min, the temperature was raised to 850° C. at a rate of 0.75° C./min and maintained at 850° C. for 20 minutes. Then, it was cooled to room temperature at a rate of 5° C./min in a pure nitrogen atmosphere containing no water vapor. In this way, a sintered body of the metal powder paste was formed on the ceramic substrate to obtain a sintered body/ceramic laminate. The surface resistance and the thickness of the circuit having a width of 5 mm and a length of 20 mm obtained by cooling to room temperature were measured, and the specific resistance was calculated by averaging three points. The results are shown in Table 1.

[Tape Peeling Test]

After attaching a carbon double-sided tape (available from Nissin EM Co., Ltd.) to the circuit and substrate obtained in the above test, a tape peeling test was performed in accordance with JIS Z 0237: 2009 at a peeling angle of 90° and a peeling speed of 5 mm/s, and it was checked whether or not the circuit adhered to the adhesive surface of the tape. When at least a part of the circuit (sintered body) was peeled off from the substrate in one peeling test, it was judged as x (cross), when it was peeled off in two or three times, it was judged as Δ (triangle), and when it was peeled off in four or more times, it was judged as ○ (circle). The results are shown in Table 1.

TABLE 1

| | Coupling agent | | | Coupling agent pretreatment | |
|---|---|---|---|---|---|
| | Type | 1 wt % aqueous solution pH | Mass μ(g) of Si, etc. adhered to 1 g of metal powder | pH | Concentration/wt % |
| Example 1 | Epoxy silane | 5.4 | Si: 2600 | 12.5 | 20 |
| Example 2 | Egaxy silane | 5.4 | Si: 9100 | 12.5 | 20 |
| Example 3 | Egoxv silane | 5.4 | Si: 250 | 12.5 | 20 |
| Example 4 | Egoxy silane | 5.4 | Si: 1300 | 12.5 | 20 |
| Example 5 | Epoxy silane | 5.4 | Si: 2500 | 12.5 | 20 |
| Example 6 | Egoxy silane | 5.4 | Si: 2400 | 12.5 | 20 |
| Example 7 | Epoxy skane | 5.4 | Si: 2500 | 12.5 | 50 |
| Example 8 | Epoxy silane | 5.4 | Si: 2500 | 12.5 | 12 |
| Example 9 | Epoxy silane | 5.4 | Si: 2500 | 12.5 | 20 |
| Example 10 | Epoxy silane | 5.4 | Si: 2500 | 12.5 | 20 |
| Example 11 | Vinyl silane | 5.9 | Si: 2400 | 13 | 20 |
| Example 12 | Methacryl silane | 6.1 | Si: 2400 | 13 | 20 |
| Example 13 | Acrylic silane | 6.4 | Si: 2500 | 13 | 20 |
| Example 14 | Mercapto silane | 6.0 | Si: 2400 | 13 | 20 |
| Example 15 | Titanate | 6.2 | Ti: 2800 | 13 | 20 |
| Example 16 | Zirconate | 3.0 | Zr: 2700 | 13 | 20 |
| Comparative Example 1 | Epoxy silane | 5.4 | Si: 180 | 12.5 | 20 |
| Comparative Example 2 | Epoxy siane | 5.4 | Si: 12000 | 12.5 | 20 |
| Comparative Example 3 | Epoxy silane | 5.4 | Si: 2400 | 9 | 20 |
| Comparative Example 4 | Epoxy silane | 5.4 | Si: 2600 | 13.8 | 20 |
| Comparative Example 5 | Epoxy silane | 5.4 | Si: 2500 | 12.5 | 5 |
| Comparative Example 6 | Vinyl silane | 5.9 | Si: 2200 | 5.80 | 20 |
| Comparative Example 7 | Methacryl silane | 6.1 | Si: 2000 | 6.00 | 20 |
| Comparative Example 8 | Acrylic silane | 6.4 | Si: 2100 | 6.20 | 20 |
| Comparative Example 9 | Mercapto silane | 6.0 | Si: 1800 | 5.90 | 20 |
| Comparative Example 10 | Titanate | 6.2 | Ti: 2000 | 6.00 | 20 |
| Comparative Example 11 | Zirconate | 3.0 | Zr:1800 | 2.80 | 20 |

| | Cake water | Metal powder | | | 850° C. sintered body | |
|---|---|---|---|---|---|---|
| | content before drying/% | Type | Sintering starting temperature/° C. | Coating film Ra/μm | Specific resistance μΩ · cm | Tape peeling |
| Example 1 | 9 | Cu | 910 | 0.04 | 1.9 | ○ |
| Example 2 | 30 | Cu | 930 | 0.19 | 2.7 | ○ |
| Example 3 | 4 | Cu | 510 | 0.07 | 2.2 | Δ |
| Example 4 | 6 | Cu | 310 | 0.05 | 2.4 | ○ |
| Example 5 | 8 | Cu | 940 | 0.19 | 2.8 | Δ |
| Example 6 | 9 | Cu | 080 | 0.03 | 2 | Δ |
| Example 7 | 4 | Cu | 880 | 0.17 | 2.3 | Δ |
| Example 8 | 15 | Cu | 890 | 0.04 | 2.1 | Δ |
| Example 9 | 8 | Ni | 870 | 0.04 | 8.2 | ○ |
| Example 10 | 8 | Ag | 850 | 0.08 | 1.9 | ○ |
| Example 11 | 10 | Cu | 830 | 0.07 | 2.3 | ○ |
| Example 12 | 10 | Cu | 800 | 0.08 | 2.3 | ○ |
| Example 13 | 10 | Cu | 820 | 0.07 | 2.4 | ○ |
| Example 14 | 10 | Cu | 830 | 0.08 | 2.3 | ○ |
| Example 15 | 9 | Cu | 820 | 0.04 | 2.1 | ○ |
| Example 16 | 9 | Cu | 810 | 0.04 | 2.2 | ○ |
| Comparative Example 1 | 3 | Cu | 420 | 0.06 | 2.3 | x |
| Comparative Example 2 | 9 | Cu | 980 | 0.31 | 3.3 | x |
| Comparative Example 3 | 9 | Cu | 470 | 0.06 | 2.2 | x |
| Comparative Example 4 | 9 | Cu | 890 | 0.38 | 2.5 | x |
| Comparative Example 5 | 30 | Cu | 480 | 0.08 | 2.2 | x |
| Comparative Example 6 | 10 | Cu | 410 | 0.25 | 2.4 | x |
| Comparative Example 7 | 10 | Cu | 420 | 0.24 | 2.5 | x |
| Comparative Example 8 | 10 | Cu | 400 | 0.28 | 2.4 | x |
| Comparative Example 9 | 10 | Cu | 410 | 0.31 | 2.7 | x |
| Comparative Example 10 | 10 | Cu | 420 | 0.27 | 2.5 | x |
| Comparative Example 11 | 10 | Cu | 430 | 0.26 | 2.4 | x |

DISCUSSION

The metal powders of Examples 1 to 16 in which the surface treatment conditions with the coupling agent were appropriate had significantly improved sintering delay property even if the coupling agent was other than aminosilane. Furthermore, the conductor-ceramic laminates prepared by using these metal powders were excellent in bonding property between the ceramic and the conductor.

On the other hand, in Comparative Example 1, since the adhesion amount of metal derived from the coupling agent was too low, the sintering delay property was insufficient, and the bonding property between the ceramic and the conductor was insufficient.

In Comparative Example 2, the adhesion amount of metal derived from the coupling agent was too high, which made it difficult to crush the surface-treated metal powder, resulting in a decrease in dispersibility of the surface-treated metal powder. Therefore, the surface roughness of the coating film became large, the specific resistance became large, and the bonding property between the ceramic and the conductor was insufficient.

In Comparative Example 3, the adhesion amount of metal derived from the coupling agent was appropriate, but the pH at the time of pretreating the coupling agent was too low, so that the self-condensation reaction of the coupling agent did not proceed. Therefore, the sintering delay property was insufficient, and the bonding property between the ceramic and the conductor was insufficient.

In Comparative Example 4, the adhesion amount of metal derived from the coupling agent was appropriate, but the pH at the time of pretreating the coupling agent was too high, so that the self-condensation reaction of the coupling agent progressed too much. For this reason, the coupling agent gelled and the dispersibility of the surface-treated metal powder was lowered, so that the surface roughness of the coating film became large and the bonding property between the ceramic and the conductor was insufficient.

In Comparative Example 5, the adhesion amount of metal derived from the coupling agent was appropriate, but the self-condensation reaction of the coupling agent did not proceed because the concentration of the coupling agent during the pretreatment was too low. As a result, the sintering delay property was insufficient, and the bonding property between the ceramic and the conductor was insufficient.

In Comparative Examples 6 to 11, the adhesion amount of metal derived from the coupling agent was appropriate, but the self-condensation reaction of the coupling agent did not proceed because the pH of the coupling agent during the pretreatment was not controlled. As a result, the sintering delay property was insufficient, and the bonding property between the ceramic and the conductor was insufficient.

The invention claimed is:

1. A metal powder surface-treated with at least one coupling agent comprising Si, Ti, Al, or Zr, wherein a total adhesion amount of Si, Ti, Al, and Zr is 200 μg to 10,000 μg with respect to 1 g of the surface-treated metal powder, wherein a 1% by mass aqueous solution of the coupling agent indicates a pH of 7 or less, and the coupling agent is pretreated to promote a self-condensation reaction by mixing the coupling agent with an alkaline aqueous solution having a pH of 11.5 to 13.5 before surface-treating the metal powder, such that a plurality of oxide layers derived from the coupling agent is formed on a surface of the metal powder, and wherein a sintering starting temperature is 500° C. or higher.

2. The surface-treated metal powder according to claim 1, wherein the sintering starting temperature is 700° C. or higher.

3. The surface-treated metal powder according to claim 1, wherein the coupling agent has an epoxy group at an end.

4. The surface-treated metal powder according to claim 1, wherein the metal powder comprises a copper powder.

5. The surface-treated metal powder according to claim 1, wherein an adhesion amount of Si is 200 μm or more with respect to 1 g of the surface-treated metal powder.

6. A metal powder slurry, comprising the surface-treated metal powder according to claim 1 and water.

7. A conductive composition, comprising the surface-treated metal powder according to claim 1, a binder resin, and a dispersion medium.

8. The conductive composition according to claim 7, wherein when a coating film is formed by coating the conductive composition onto a slide glass using an applicator with a 25 μm gap at a moving speed of 5 cm/sec, and drying at 120° C. for 10 minutes, an arithmetic average roughness Ra of the coating film in a coating direction measured with a stylus type roughness meter is 0.2 μm or less.

9. A composite of a ceramic and a conductor, manufactured by using the conductive composition according to claim 7.

10. A laminated ceramic capacitor manufactured by using the conductive composition according to claim 7.

11. A ceramic circuit board manufactured by using the conductive composition according to claim 7.

12. A sintered body of the surface-treated metal powder according to claim 1.

13. The sintered body according to claim 12, wherein a specific resistance is 3.0 μΩ·cm or less.

* * * * *